US005353455A

United States Patent [19]

Loving et al.

[11] Patent Number: 5,353,455

[45] Date of Patent: Oct. 11, 1994

[54] PADDING BODY WITH INDIVIDUAL MODULAR ELEMENTS

[75] Inventors: George Loving; Douglas M. Wilson, both of Richmond, Va.

[73] Assignee: Carpenter Co., Richmond, Va.

[21] Appl. No.: 59,604

[22] Filed: May 12, 1993

[51] Int. Cl.[5] ..... A47C 27/14; A47C 27/16

[52] U.S. Cl. ..... 5/481; 5/464; 5/468; 29/451

[58] Field of Search ..... 5/481, 468, 464, 465, 5/474, 900.5, 901; 29/451

[56] References Cited

U.S. PATENT DOCUMENTS

| | | | |
|---|---|---|---|
| 3,679,263 | 7/1972 | Cadiou | 297/DIG. 1 |
| 3,866,252 | 2/1975 | Rogers, Jr. . | |
| 3,885,259 | 5/1975 | Cheong | 297/453 |
| 4,070,719 | 1/1978 | Morgan . | |
| 4,092,751 | 6/1978 | Burkholder et al. | 297/DIG. 1 |
| 4,673,452 | 6/1987 | Awdhan | 156/254 |
| 4,809,374 | 3/1989 | Saviez | 5/420 |

FOREIGN PATENT DOCUMENTS

| | | | |
|---|---|---|---|
| 2339645 | 2/1975 | Fed. Rep. of Germany . | |
| 3303615A1 | 8/1984 | Fed. Rep. of Germany . | |
| 50104805 | 2/1949 | Japan . | |
| 476678 | 12/1937 | United Kingdom | 5/481 |

OTHER PUBLICATIONS

Preventix® Le Coussin (two pages in French) brochure date not indicated.

Preventix® "Ergonomical Mattress" 6 pages in English-(date unknown).

Decubitus Confortable et Sans Risques avec Préventix (4 pages in French)-(date unknown).

Iris® Preventix® label for a "Pressure Relief Mattress" used in commerce Jan. 3, 1992.

*Primary Examiner*—Alexander Grosz

*Attorney, Agent, or Firm*—Beveridge, DeGrandi, Weilacher & Young

[57] ABSTRACT

A padding body that has flexible grid member with apertures formed in it. The apertures are defined by bordering sections of the grid member. The padding body includes individual modular elements with each modular element being resilient and each modular element having an intermediate section and an upper protuberance extending upwardly off from the intermediate section. The individual modular elements have a peripheral slit or recess formed in the intermediate section. Each of the individual modular elements are releasably fixed within a respective one of the apertures formed in the grid. One embodiment of the padding body includes a frame structure formed entirely of foam material. The frame structure includes foam blocks stacked two high. Apertures and the bordering sections of the grid member spaced about the periphery of the grid member are secured between the upper and lower stacked foam blocks so as to suspend the grid member. The height of the individual modular elements is preferably of the same elevation as the stacked foam blocks such that the grid is suspended between the border blocks. A plurality of transverse columns of modular elements positioned longitudinally intermediate of the transverse columns is formed of a firmer polyurethane foam to provide better support in those areas of a body which need added support.

31 Claims, 8 Drawing Sheets

PADDING BODY WITH INDIVIDUAL MODULAR ELEMENTS

FIELD OF INVENTION

The present invention relates to a padding body having a plurality of resilient, individual modular elements supported by a grid member. More specifically, the present invention is directed at a padding body formed of a plurality of individual foam blocks releasably secured within apertures formed in a supporting, flexible grid structure.

BACKGROUND DISCUSSION

A large variety of padding bodies exist in the prior art including padding bodies which feature an underlying common base section from which extends resilient protuberances (See, for example, U.S. Pat. Nos. 3,233,885; 3,679,263; 4,092,751; 4,435,015; 4,509,510; 4,509,510; 4,529,248 and 4,686,724).

In addition, a number of cushioning elements are known which feature both upper and bottom protuberances extending from an integral base section. (See, for example, U.S. Pat. Nos. 3,866,252; 4,070,719; GB 476,678; GB 1310373 and DE 2131448).

DE 3303615 illustrates a padding body wherein individual modular elements are positioned within an underlying plastic support plate, subdivided into compartments by partitions to prevent lateral shifting of the modular elements.

U.S. Pat. No. 4,809,374 reveals a padding body which, in a first embodiment, features individual members inserted in openings provided in a grid. The modular elements are described as having a base from which extends a protuberance. The protuberance of each modular element is designed for insertion through the opening with the base of each protuberance being in contact with the under surface of the grid to prevent the modular elements from completely sliding through the openings. In another embodiment, designed for use without the requirement for an underlying mattress, protuberances extend to opposite sides of the base and a second grid is provided which is placed underneath and has an upper surface in contact with the base portion of each modular element such that the base portion of each modular element is sandwiched between the two grids.

The aforementioned references wherein the protuberances extend off from a common base suffer from the drawback of having protuberances that are not individual modular elements which can be individually or collectively removed for purposes such as support adjustment, cleaning, replacement, etc. Also, the base portion is susceptible to shear forces which can cause tearing at the base portion.

Padding bodies such as those described in the aforementioned DE 3303615 and U.S. Pat. No. 4,809,374 include individual modular elements which can be removed from the supporting and interconnecting member. DE 3303615, however, relies upon an underlying plate structure which prevents the use of both sides of the pad for human support and is susceptible to having the individual blocks becoming inadvertently disengaged from the support plate or too restricted from lateral shifting if the dividers are made too high or too compressing. U.S. Pat. No. 4,809,374 is arranged for reverse side use, but the design of the individual modular elements and grid is subject to improvement with respect to maintaining the individual modular elements interconnected. Also, the manner in which the modular elements are retained with respect to the grid makes the entire padding body susceptible to too much flexibility and insufficient rigidity for some uses (e.g., as a mattress). In an attempt to compensate, U.S. Pat. No. 4,809,374 discloses the use of a second grid plate to decrease flexibility and increase rigidity and support. This, of course, increases the complexity of manufacturing and assembling.

SUMMARY OF THE INVENTION

The present invention is designed to avoid the drawbacks described above and to provide a padding body with individual modular elements that are uniquely designed with respect to the grid member so as to provide sufficient rigidity to the padding body while maintaining a high degree of comfort. The invention also presents a padding body arrangement which allows for strategic positioning of varying density modular elements so as to improve comfort and support characteristics in a unique manner. Also, the present invention features an embodiment having a surrounding frame structure which supports the grid member in a hammock-like suspended state so as to further increase the comfort of the padding body. The design of the present invention is such that the invention is particularly suited for use as a mattress.

The advantageous design of the present invention features a padding body comprised of a flexible grid containing apertures through which flexible modular elements are inserted. The modular elements extend above and below the grid member so as to provide an upper and lower padded surface and are preferably formed of polyurethane foam. The apertures are defined by bordering sections of the grid member with each bordering section having an upper and a lower surface.

Each modular element is resilient and each has an intermediate section and an upper protuberance extending upwardly off from the intermediate section. The individual modular elements each include a peripheral recess formed in the intermediate section, and each of the individual modular elements are releasably fixed within a respective one of the apertures formed in the grid member. The bordering sections of the grid member extend into the peripheral recesses formed in the modular elements such that the upper and lower surfaces of the bordering sections are in contact with the intermediate section. In this way, the modular elements are adequately detained with respect to the grid member and yet independently compressible. Also, the positioning of each bordering section of the grid member within the recess formed in the intermediate section of each modular element helps limit the rotation and movement of the modular elements due to contact between the grid member and the surfaces of the intermediate section defining the recess.

The modular elements also preferably feature a base section formed of the intermediate section and a bottom protuberance extending downwardly off from the intermediate section. The upper protuberance also preferably has a horizontal cross-sectional area which is less than a horizontal cross-sectional area of the intermediate section and the lower protuberance has a horizontal cross-sectional area which is less than a horizontal cross-sectional area of the intermediate section.

In a preferred embodiment the modular elements are unitary polyurethane foam blocks with a square or rectangular cross-section both in the intermediate section and in the upper and lower protuberances. The upper and lower protuberances are also preferably of the same size and shape.

One embodiment of the present invention includes a frame structure connected with and surrounding the grid member. The frame structure is preferably formed of polyurethane foam border blocks in a stacked arrangement and extending about the external periphery of the grid member. The polyurethane foam forming the border blocks is preferably firmer than the foam forming the modular elements. The grid member is formed of a pliable, plastic material and includes a row of unfilled apertures positioned along the external periphery of the grid member. These unfilled apertures and the portions of the grid member defining the unfilled apertures are received between upper and lower stacked border blocks, and the upper and lower border blocks are secured to each other (e.g., an adhesive) such that the portions of the grid member defining the unfilled apertures are maintained secured between the upper and lower border blocks and such that the upper and lower border blocks are adhered together in the area of the unfilled apertures.

The grid member is comprised of a single unitary plastic sheet or plurality of plastic sheets joined together in an overlapping arrangement to achieve greater padding body widths. When the grid member is formed of a plurality of sheets, the apertures in each are aligned in the overlapping region and the double thick portions of the grid member are received within the recesses formed in intermediate sections. The padding body with overlapping grid segments includes fastening members extending through the overlapping grid segments so as to connect the overlapping sections together. The fastening elements preferably take the form of grommets with a central aperture.

The modular elements are dimensioned and arranged in position in the grid member such that each intermediate section is within 0 to $\frac{1}{8}$ of an inch or 0 to 3 mm of an adjacent intermediate section. Preferably, the intermediate sections are essentially in contact (e.g., within the lower half of the above-described range). The upper protuberances are further spaced from one another than are the intermediate sections due to the smaller cross-sectional areas of the protuberances.

The upper protuberances are preferably spaced $\frac{3}{8}$ of an inch or 10 mm apart with respect to an adjacent upper protuberance. Also the upper protuberances, the lower protuberances or both the upper and lower protuberances can be additionally provided with a convoluted contact surface (e.g., checkerboard arranged protrusions and recesses) for contact with either a person or the underlying support. In addition, the modular elements themselves can be constructed of foams of varying densities, or Indentation Force Deflection (IFD) ranges to provide a firmer or softer padding surface. The arrangement of the modules can be altered to provide bands or zones of varying firmness.

The peripheral recess formed in the intermediate section extends inwardly from an external surface of the intermediate section towards a central axis of the modular element for a distance which represents about 25 to 31% of a distance from the exterior surface of the modular element to the central axis of the modular element. The bordering sections of the grid member preferably extend inward to the inner end of the recess. The recess is made very narrow in height such that the surfaces of the intermediate section above and below the bordering sections are normally maintained in contact with the bordering sections. The foam of the intermediate section is compressed due to the bordering section's thickness being greater than the recess thickness. A greater degree of intermediate section compression above and below the recess is experienced when a double thick (or even a triple thick) bordering section of overlapping grid segments is received by the recesses in the intermediate sections.

The apertures formed in the grid member are preferably arranged in aligned rows and columns and include those to be filled with the modules and those to be left unfilled to provide an anchoring surface for the frame structure.

Unfilled peripheral apertures of the frame are positioned along the sides and ends of the grid member, and the unfilled apertures fixedly receive the frame structure so as to retain the grid member suspended between an upper and lower surface of the frame structure.

In a preferred embodiment, the frame structure is entirely formed of a foam material and comprised of a plurality of elongated foam blocks stacked two high one on the top surface of the grid and one on the bottom surface of the grid. The stacked blocks are joined end to end or end to side along the sides and ends of the grid. The blocks are arranged end to side at the corners of the frame structure to complete a rectangular shaped frame structure. Further, the apertures in the grid member are preferably square or rectangular to match the periphery of the intermediate section and the apertures have an area which is less than that of the intermediate section and have an area which is the same, less or more than the cross-sectional area of the upper protuberance or the lower protuberance. The height of the frame structure (e.g., the height of the stacked blocks) is preferably the same as the height of the individual modular blocks. The intermediate section preferably comprises about 50 to 70%, or, more preferably 61 to 62% of the total height of each modular block with the upper and lower protuberances each representing one-half of the remaining percentage.

The invention includes a method of assembling a padding body which comprises forming a lower border block arrangement (preferably rectangular); forming an upper border block arrangement (preferably rectangular); positioning a peripheral portion of a grid member between the upper and lower border block arrangements; securing the upper body block arrangement to the lower border block arrangement; securing the portions of the grid member's bordering sections defining the unfilled apertures between the upper and lower border block arrangement; and inserting a plurality of individual modular elements into apertures formed in the grid member such that the bordering sections of the grid member, which define the apertures, are received within peripheral recesses formed in an intermediate section of the modular elements.

The present invention will be more fully understood from the detailed description given herein below and the accompanying drawings which are given by way of illustration only, and thus are not meant to limit the present invention and wherein:

DETAILED DESCRIPTION OF THE PREFERRED EMBODIMENTS

Figure 1:
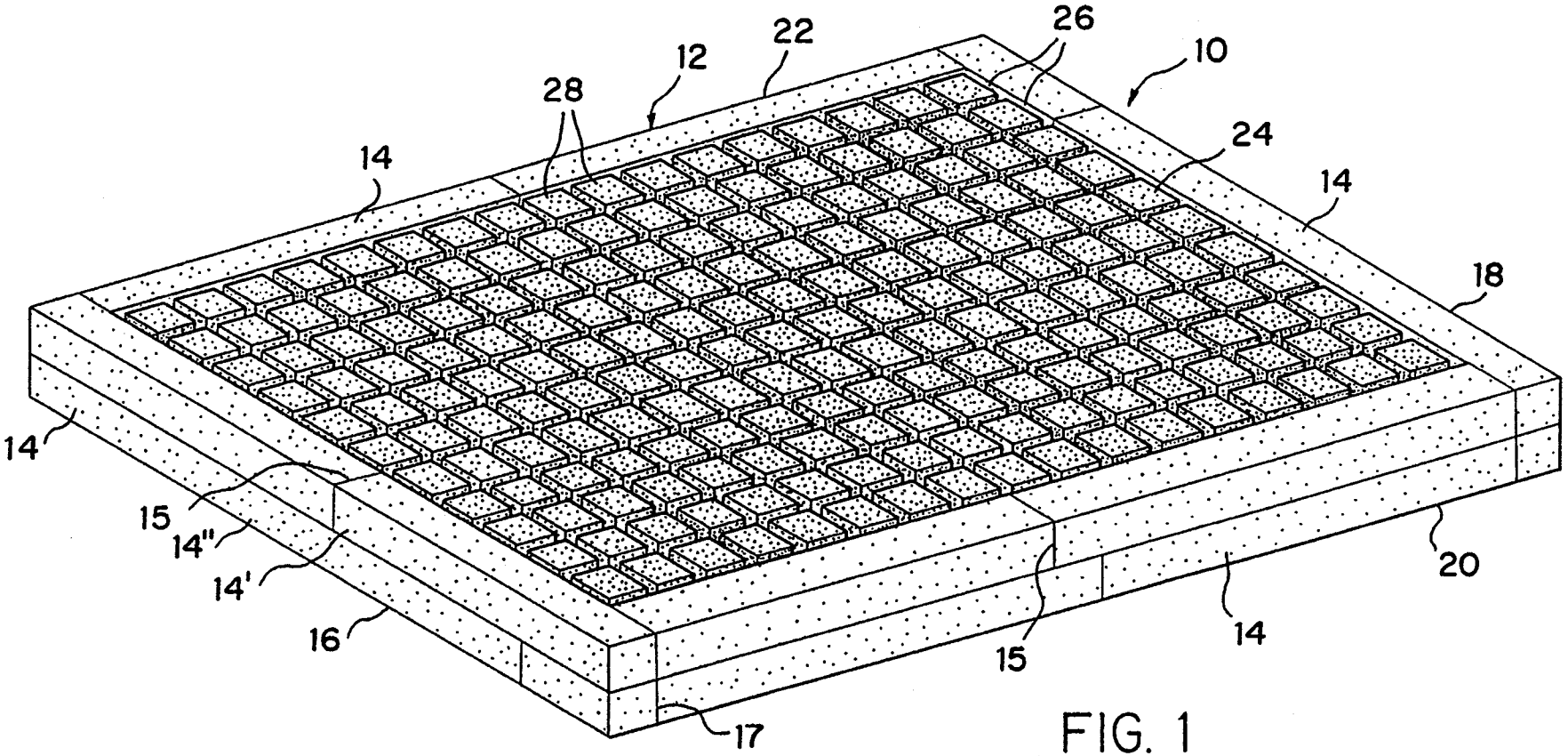
FIG. 1 illustrates a perspective view of a preferred embodiment of the present invention.

FIG. 1 shows in perspective a preferred embodiment of the present invention. As shown in FIG. 1, padding body 10 comprises frame structure 12. Frame structure 12 is made up of a plurality of elongated border blocks 14 arranged so as to form first padding body end 16, second padding body end 18, first padding body side 20 and second padding body side 22 of padding body 10. Frame structure 12 is formed by stacking a plurality of upper border blocks 14' onto lower border blocks 14" so as to form the rectangular structure shown in FIG. 1. The frame structure can assume a variety of shapes (e.g. square, circular, hexagonal, heart shaped, etc.), but is shown here in the preferred rectangular mode.

In a preferred embodiment, a plurality of different sized upper border blocks are joined in an end/end arrangement 15 intermediate the four corners of the rectangular frame structure and arranged in a side/end configuration 17 at the corners. The present invention is particularly useful as a mattress having the standard sizes associated with the various size mattresses available on the market (e.g. queen, king, full, twin, etc.). Preferably, the height of the individual modular elements is the same as the stacked height for the border blocks. A suitable height is 6½ inches (165 mm).

FIG. 1 further illustrates a plurality of longitudinal or end-to-end rows of individual modular elements 24 with a few of the rows designated by number 26. A few adjacent transversely extending columns are designated by reference number 28. A suitable material for forming the border blocks and modular elements is a polyurethane foam material sold under the brand name of Qualux by E. R. Carpenter Company, Inc. of Richmond, Va. The Qualux foam is available with a variety of different density and IFD value characteristics.

Figure 2A:
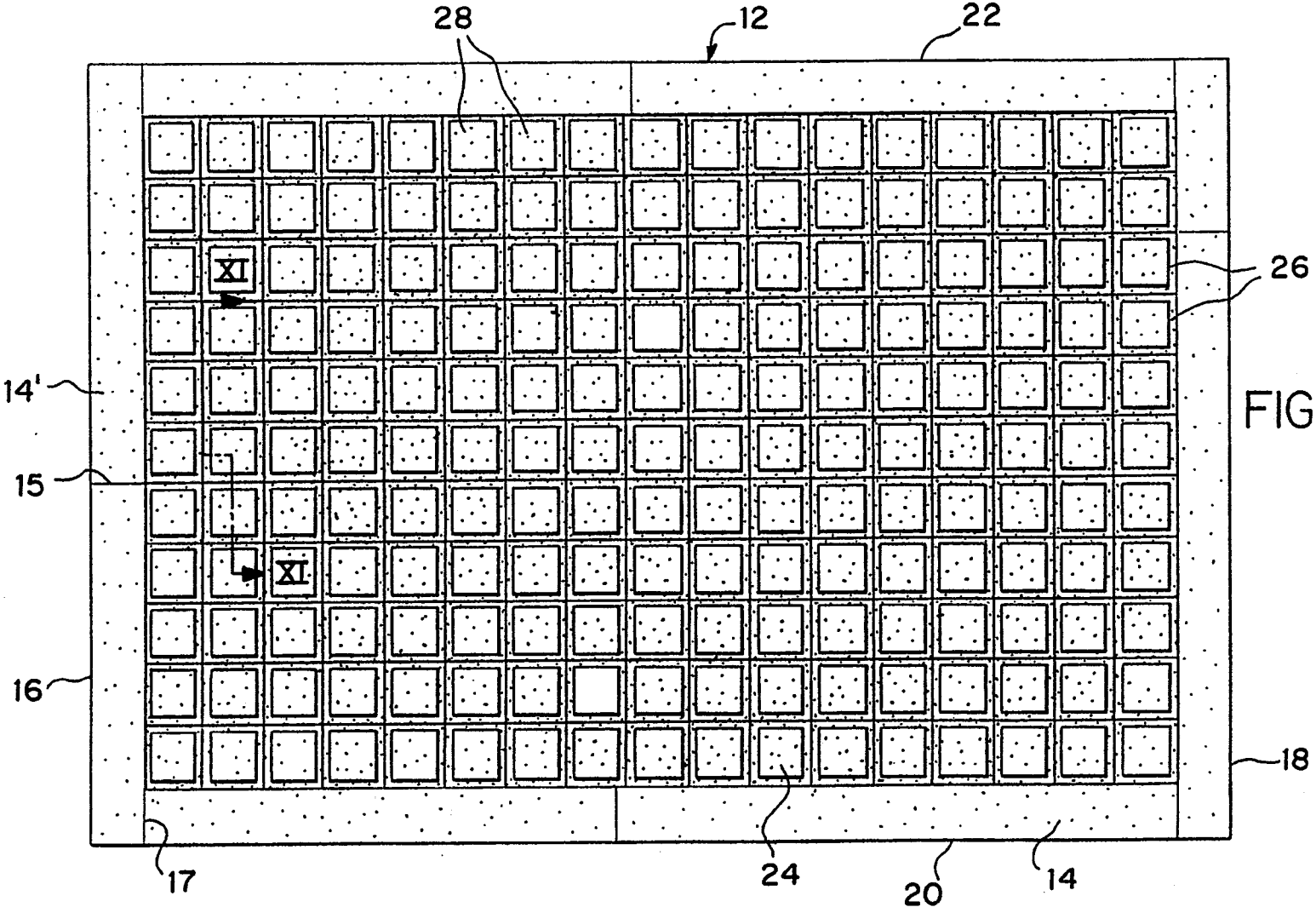
FIG. 2A shows a top planar view of that which is shown in FIG. 1.

FIG. 2A illustrates a top, planar view of that which is shown in FIG. 1. FIG. 2A illustrates the side/end adjoinment 17 of the border blocks at the corners of the rectangular frame structure 12 as well as the end/end adjoinment 15 intermediate of the corners.

With reference to FIG. 2A, individual modular elements 24 are arranged in rows and columns 26, 28 respectively, within the interior of frame structure 12.

Figure 2B:
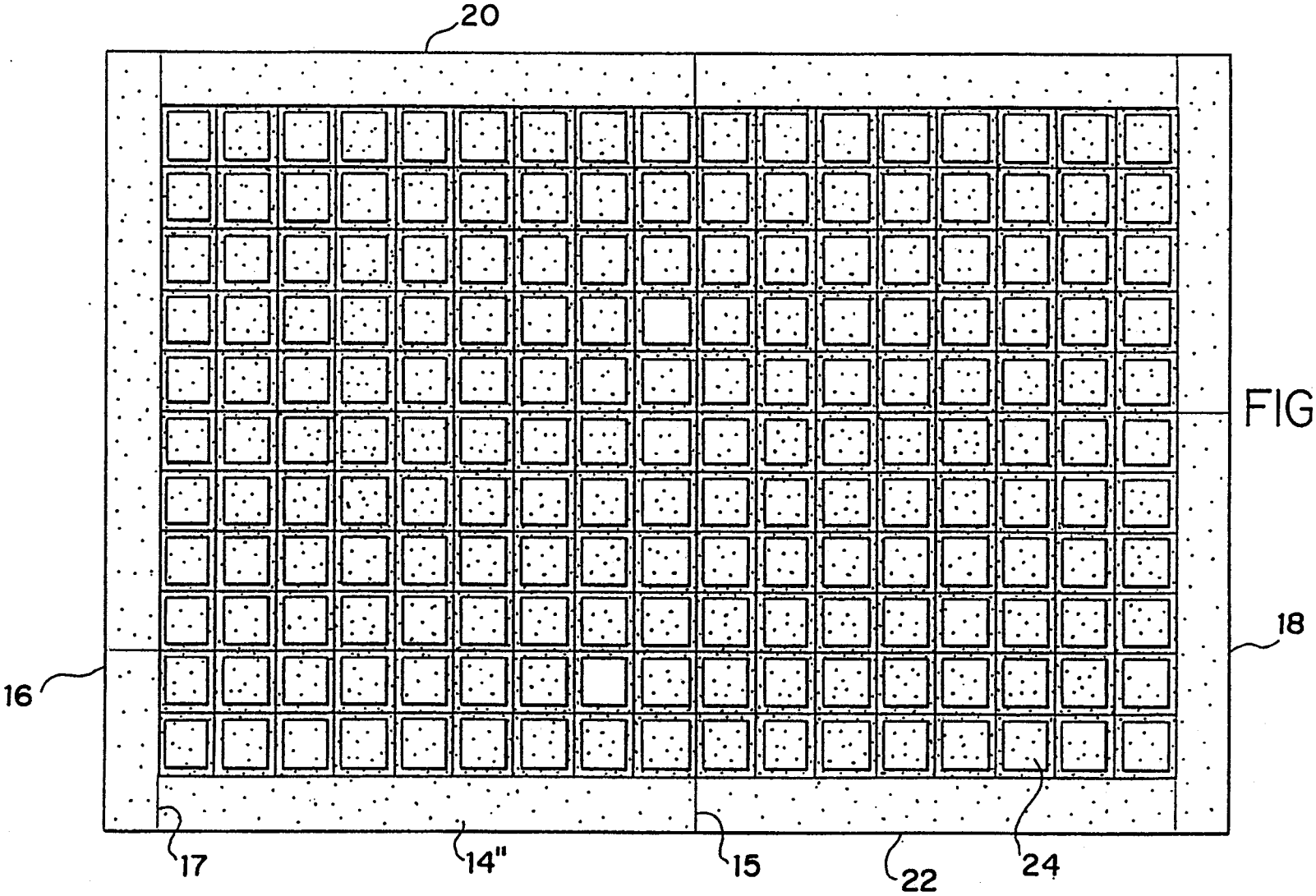
FIG. 2B shows a bottom view of that which is shown in FIG. 1.

FIG. 2B illustrates a similar arrangement for the bottom view.

Figure 8:
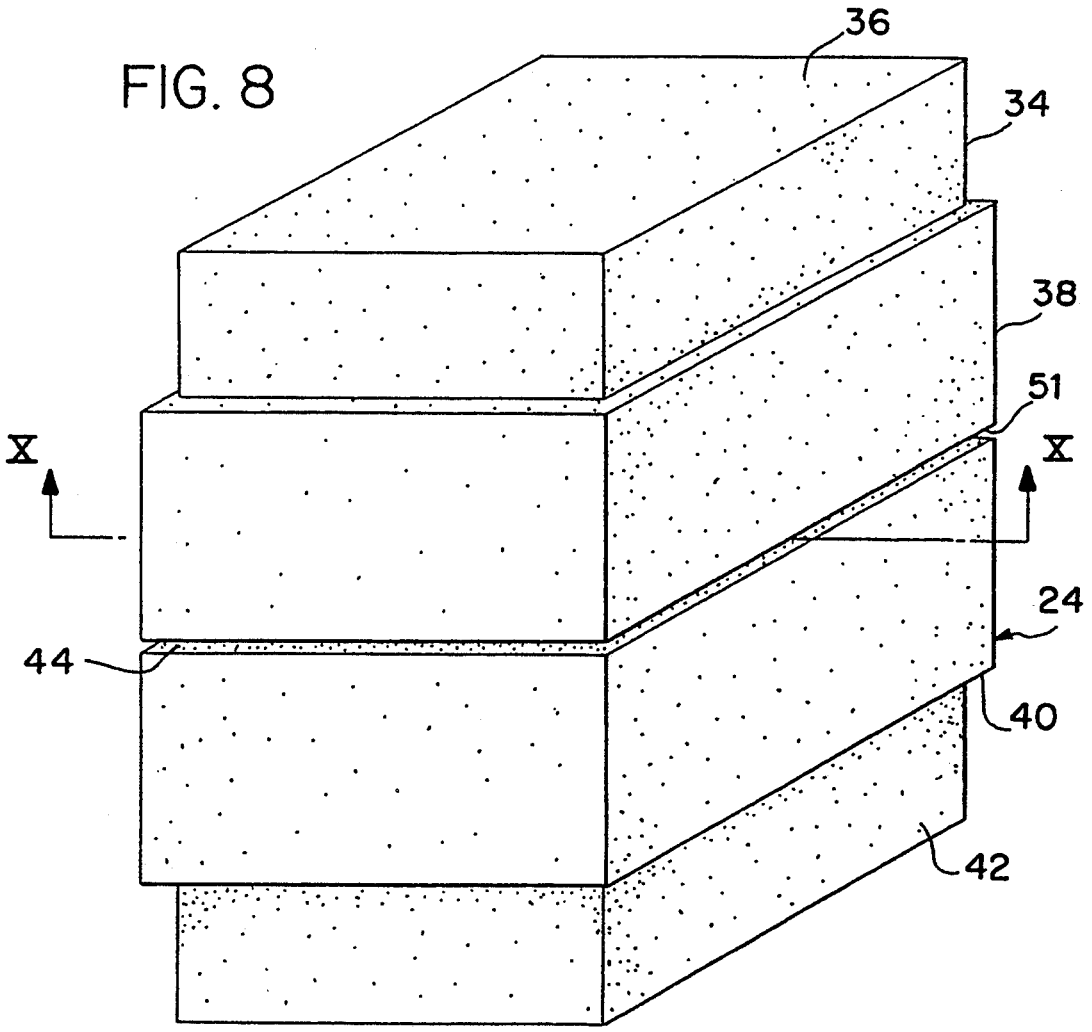
FIG. 8 shows a perspective view of one of the numerous modular elements shown in FIG. 1.
Figure 9:
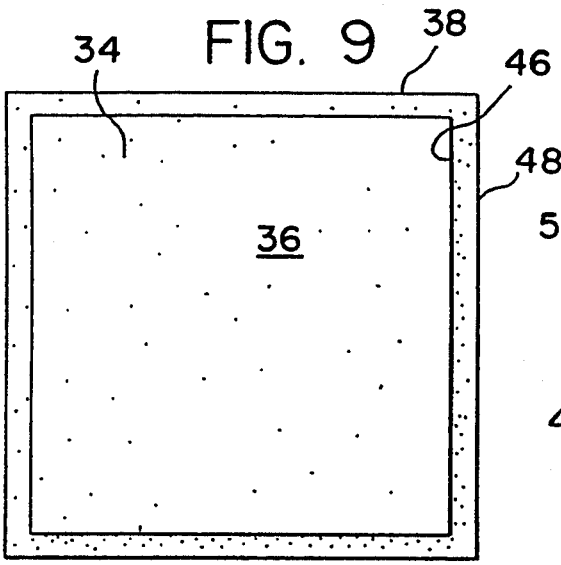
FIG. 9 shows a planar view of that which is shown in FIG. 8.
Figure 10:
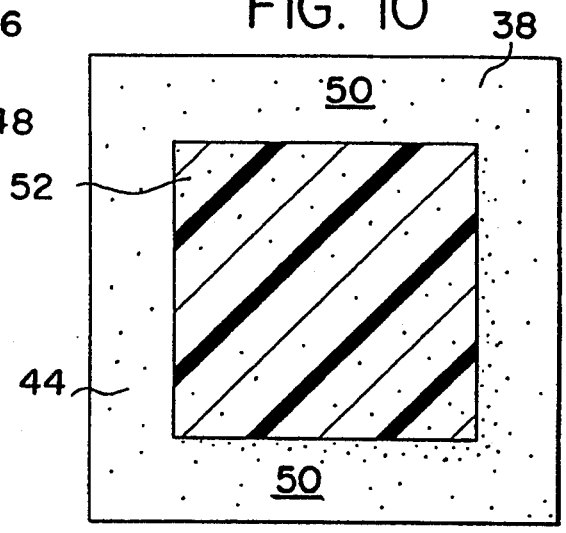
FIG. 10 shows a cross-sectional view taken along cross-section line X—X in FIG. 8.

FIGS. 8–10 show one of the modular elements in detail. As shown, each modular element 24 includes upper protuberance 34 which, in this embodiment, is in the form of a square block with an upper planar surface 36 which contacts the user when the padding body is in use. Upper protuberance 34 extends off of a peripherally larger intermediate section 38. Extending downwardly off from the bottom 40 of intermediate section 38 is bottom protuberance 42. Bottom protuberance 42 is preferably dimensioned the same as upper protuberance 36 and bottom protuberance 42 together with intermediate section 38 help form a base for the contacting upper protuberance 34. The present invention also contemplates forming the upper and bottom protuberances of different designs (e.g., the upper protuberance having a checker board upper surface with the bottom protuberance having a lower, planar contact surface). The upper and bottom protuberances are spaced a greater distance away from an adjacent upper or bottom protuberance than the distance adjacent intermediate sections are spaced so as to enhance the individual cushioning nature of each modular element.

FIG. 8 also shows peripheral recess 44 extending about the periphery of intermediate section 38 preferably at the elevational mid-point of intermediate section 38. Recess 44 is formed, for instance, in a slicing operation and is made relatively narrow so as to snugly receive a border section of the grid member when in position therein.

FIG. 9 illustrates that which is shown in FIG. 8 in a top, planar view and reveals a preferred square cross-sectional shape for upper protuberances 34 and intermediate section 38. FIG. 9 also illustrates upper protuberance having a peripheral boundary 46 which defines four sides equally spaced from a respective side of exterior peripheral boundary 48 of intermediate section 38. Preferably, the distance between adjacent boundary borders 46 and 48 of intermediate section 38 and upper protuberance 34 is from about 3/16 to ¼ inch or 5 to 7 mm or the distance between boundary 46 and boundary 48 represents about 9 to 13% of the minimum distance from boundary 48 to the central axis of the individual modular element.

FIG. 10 illustrates peripheral recess 44 extending about ½ to 5/8 inch or 12 to 16 mm into the intermediate section so as to form a lower supporting surface 50 in intermediate section 38. Peripheral recess 44 is shown to extend inwardly for an even amount from each side of boundary border 48 of intermediate section 38 so as to define an internal, undisturbed remaining portion 52 for intermediate section 38. In a preferred embodiment, the difference between the interior-most and external-most boundaries of the peripheral recess 44 represents about 25 to 31% of the minimum distance from the external most boundary to a central axis of the modular element. As will be explained in greater detail below, the recess 44 can be formed so as to maintain a variety of shapes for remaining portion 52 (shown in FIG. 10 to have a square shape) so long as the retention function described below is satisfied.

In a preferred embodiment, upper protuberance 34 represents about 19 to 20% of the overall height of individual modular element 24, intermediate section 38 represents about 61 to 62% of the overall height of individual modular element 24 and the vertical height of bottom protuberance 42 represents about 19 to 20% of the overall height of modular element 24. Also, while modular element 24 can be formed of a variety of different resilient material portions joined together, it is preferred that it be formed of a solid, unitary block of polyurethane foam with the intermediate section integral with the upper and bottom protuberance. Alternatively, the upper and bottom protuberances can be formed of a different material than that of the intermediate section 38 (e.g., more or less dense or with a different indentation load or force deflection value) and adhered to the intermediate section. Also, while contact surface 36 is shown to be planar in the upper protuberance (and is the same for the lowermost surface at the bottom protuberance 42), a convoluted surface such as a checkerboard surface in the upper protuberance and/or the bottom protuberance is also contemplated in the present invention although not shown.

FIGS. 3–6 illustrate a preferred arrangement for the stacked border blocks for the first and second sides and the first and second ends of the rectangular frame structure. Also, FIGS. 3–6 illustrate that the adjoined end/end adjoinments 15 are not vertically aligned but laterally offset from one another. Upper and lower border blocks 14' and 14" preferably have the same height and width. By not having the adherence seams aligned for the laterally offset elongated blocks, the frame structure is strengthened in a manner similar to the increased strength provided by offset layering of bricks in a brick wall.

Figure 3:
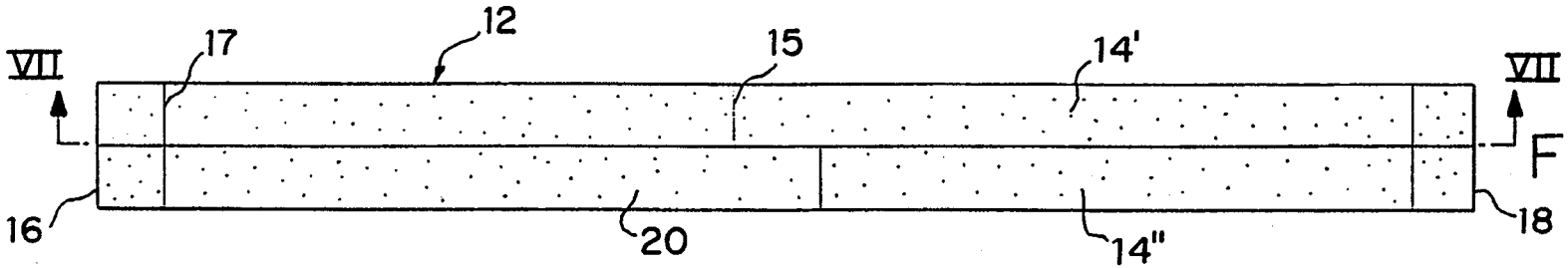
FIG. 3 shows an elevational view of the first side of the invention depicted in FIG. 1.
Figure 4:
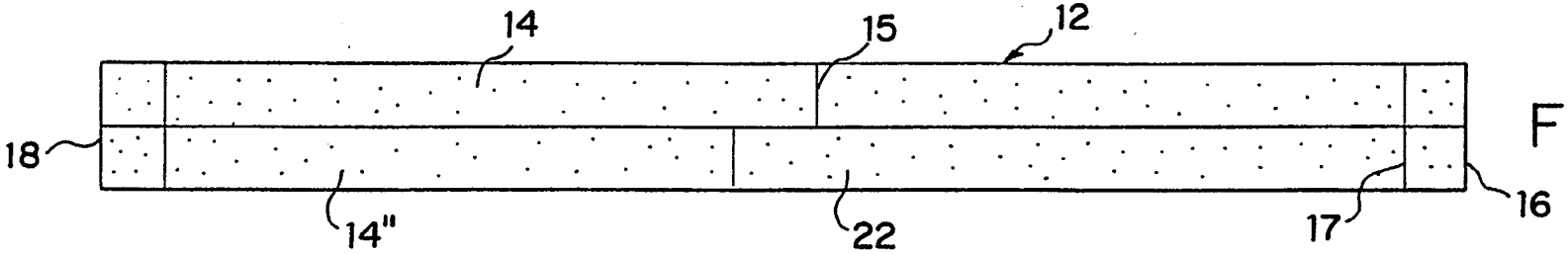
FIG. 4 shows a side elevational view of the opposite side.
Figure 5:
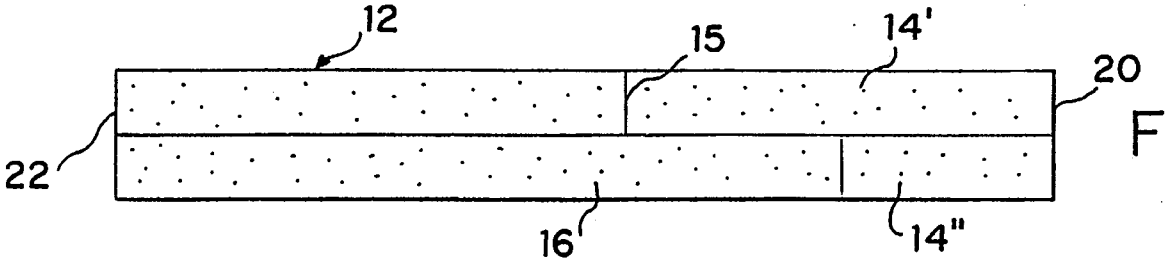
FIG. 5 shows an elevational view of a first end of the embodiment in FIG. 1.
Figure 6:
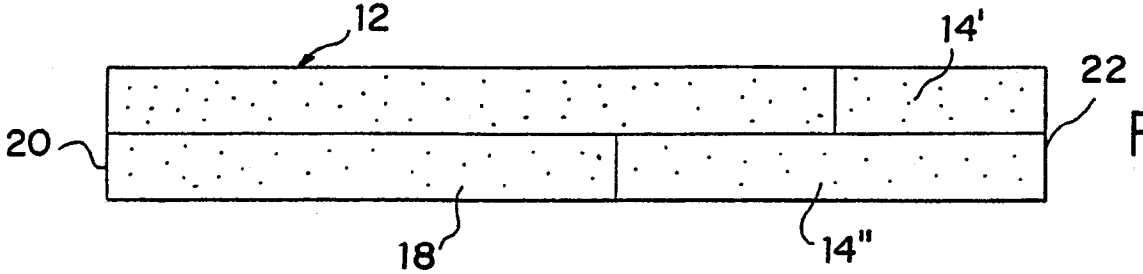
FIG. 6 shows an elevational view of an opposite end of the preferred embodiment.
Figure 7:
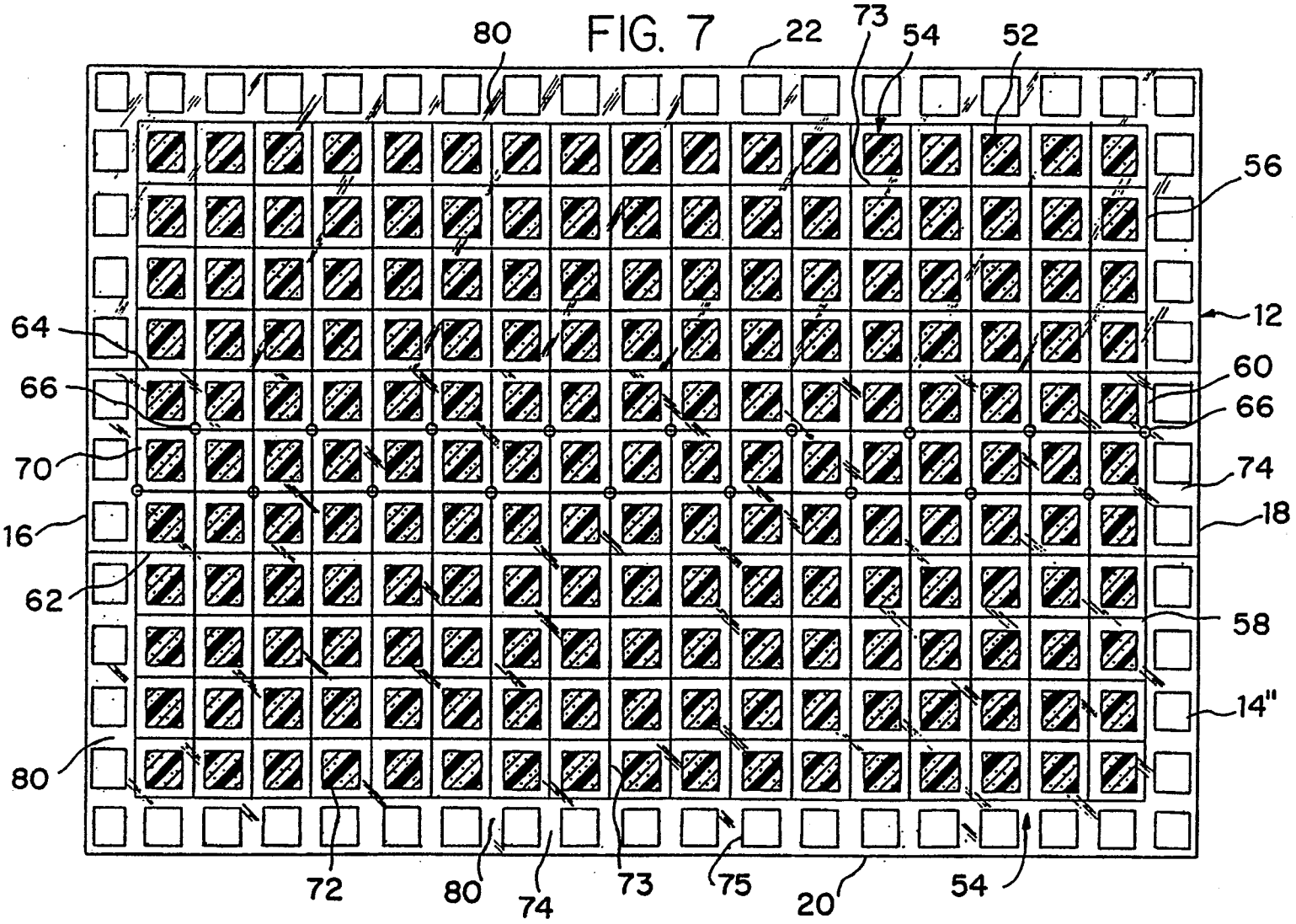
FIG. 7 illustrates a planar cross-sectional view taken along cross-section line VII—VII in FIG. 3.

FIG. 7 illustrates a cross-sectional view taken along cross-section line VII—VII in FIG. 3 just above grid member 54 which is used to retain individual modular elements 24 in position while allowing a certain degree of freedom and movement so as to enhance comfort.

Grid member 54 is positioned half-way along the height of the intermediate section so as to be sandwiched by the upper and lower surfaces of the intermediate section defining the peripheral recess 44. Thus, the grid member, in combination with the intermediate section into which the bordering sections of the grid member extends, provides sufficient rigidity and retention to make the padding body suitable for such uses as a bed mattress. Grid member 54 features a central overlapping section 60 which is made up of interior edges 62 and 64 of the overlapping first and second grid segments 56, 58.

Figure 11A:
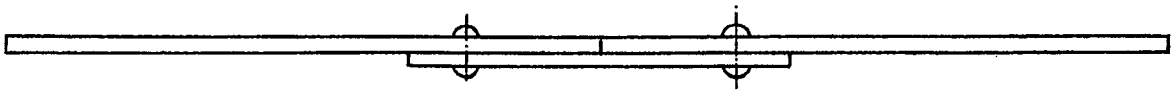
FIG. 11A shows three overlapping grid segments for a wider width padding body and an alternate embodiment of the invention.
Figure 11:
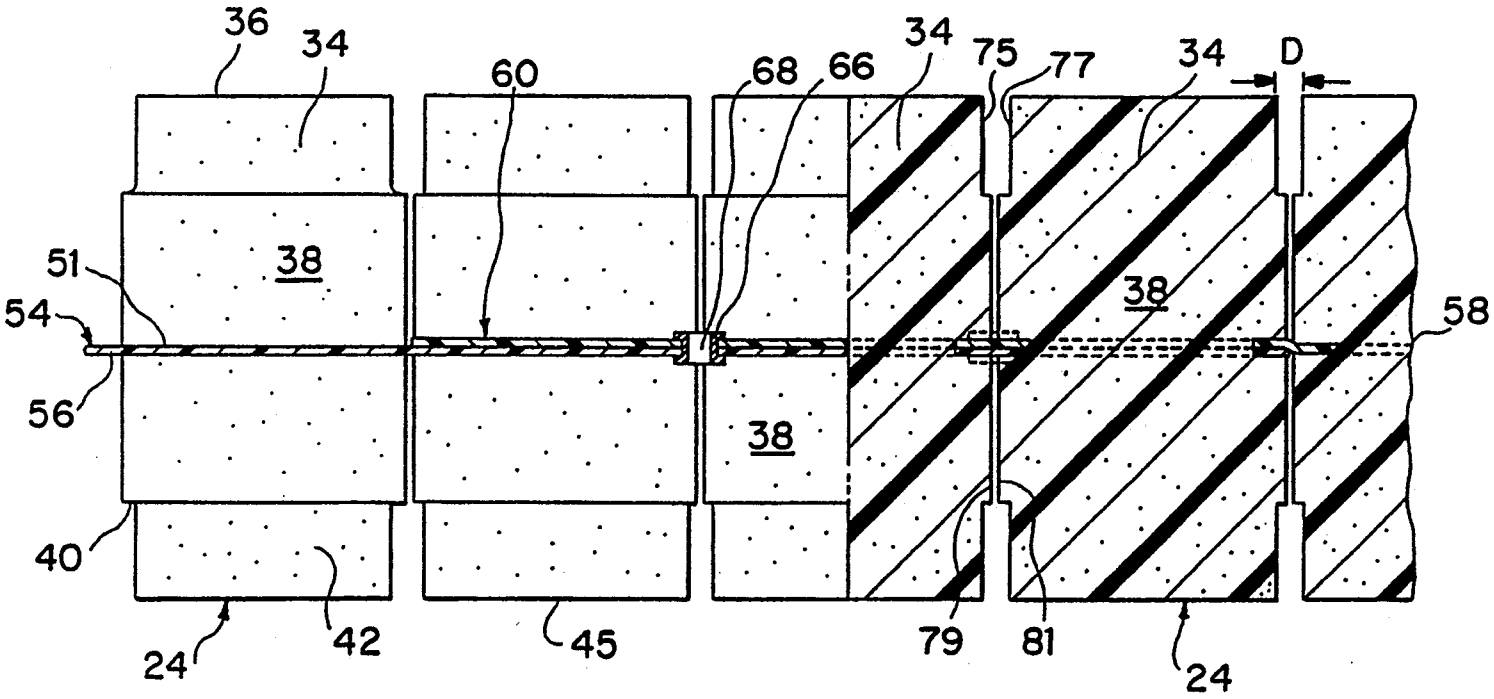
FIG. 11 shows a cut-away taken along cross-section line XI—XI in FIG. 2A.

Overlapping interior sections 62 and 64 are fastened together by way of fastening members 66 which, in a preferred embodiment, are grommet-like devices having an open central aperture (FIG. 11). As shown in FIG. 7, fastening members 66 are arranged in rows with a fastening member in one row being intermediate with respect to a pair of fastening members opposingly positioned. The fasteners are thus arranged in a staggered fashion.

Apertures are formed in both the first and second grid segments and apertures 70 represent the apertures in each grid segment which are aligned in the central section such that they overlap to form through holes which permit the insertion of the modular elements through the overlapping grid segments. Apertures 72 represent the apertures formed in the non-overlapping regions of each grid segment which receive a modular element. Apertures 70 and 72 are dimensioned so as to be essentially the same size as the internal periphery of the recessed portion of the intermediate section of the modular elements 52 (FIG. 10). Lower supporting surface 50 and an upper supporting surface 51 (FIG. 11) in intermediate section 38 expand into contact with the bordering sections of the grid extending into the recesses formed in the intermediate sections so as to retain the individual modular elements in position with respect to grid member 54. The resilient nature of the individual modular elements allows for some distortion both in a rotational manner, shifting manner and in a vertical compression manner. However, the design of the grid member and individual modular elements limits the degree of such movement and thus provides a good retention function with respect to the modular elements.

Grid member 54 is preferably formed of clear plastic such as PVC plastic and is of a single ply thickness of about 1/16 inch. This arrangement provides a sufficient degree of flexibility in the mattress, but avoids having the padding body too flexible and also avoids undue stretching in the interconnecting border section 73 of the grid member 54.

The use of the two grid segments shown in FIG. 11 provides a padding body having a width corresponding to that of a standard full size mattress. The present invention also contemplates forming padding bodies for use as a full size or larger size mattress from a single grid sheet although smaller width sheets of PVC are more advantageous from an availability and cost standpoint.

FIG. 11A illustrates an end view of three grid segments which are combined in overlapping fashion for use as the grid member in a padding body suited for use as a queen or king size mattress.

FIG. 11 represents a cross-sectional view taken along cross-section lines XI—XI in FIG. 2A and reveals that the adjacent vertical side surfaces 75, 77 of adjacent upper protuberances 34 are spaced a distance designated by D in FIG. 11. The distance D is greater than the distance between vertical side surfaces 79, 81 of intermediate section 38 for each padding body 24. FIG. 11 shows intermediate segments slightly apart. The present invention contemplates direct contact between intermediate segments during non-compressed states of the padding body up to about $\frac{1}{8}$ of an inch or 3 mm in spacing. Spacing D is preferably from about $\frac{1}{4}$ to $\frac{1}{2}$ of an inch (6.5 to 13 mm) or more preferably $\frac{3}{8}$ of an inch (9.5 mm). The spacing adds to the individualness of each of the modular elements by allowing for a degree of initial outward bulging of the modular elements prior to contact with one another. The individualness is made possible while avoiding undue lateral shifting. The arrangement of the grid member with respect to the individual modular elements also helps increase the retention function of the grid member 54 and the overall structural stability of the padding body.

FIG. 11 also illustrates the unitary nature of the individual modular elements 24. The passage of remaining portion 52 (FIG. 10) to opposite sides of grid member 54 provides for freedom in individual modular element compression along the central axis of the modular elements with little transference of lateral forces (e.g., much of the vertical forces are free to pass completely through the modular element due to the unitary nature of intermediate section 38 extending through aperture 70 (FIG. 7) and above and below the grid member). Any remaining vertical forces are transferred to the grid member and the border blocks.

Returning to FIG. 7 and FIGS. 2A and 2B, it can be seen that the exterior periphery of intermediate section 38 are also preferably at or close to contact with the interior side walls of the stacked border blocks. (It is preferred that the spacing between intermediate segments 38 and the interior portion of frame structure 12 is the same as the spacing between internally positioned adjacent intermediate sections and the spacing between the upper and lower protuberances and the border blocks is about D/2.)

FIG. 7 also illustrates the external periphery 74 of grid member 54 to be made up of a plurality of unfilled apertures 75 surrounded by bordering section 80. The unfilled apertures 75 and surrounding bordering sections 80 are positioned between the border blocks such that at least each unfilled aperture is covered above and below and, preferably, essentially all of the surrounding bordering section is covered by the upper and lower border blocks. The width of border blocks 14 is made such that the external most edge of the grid member 54 is inward of or equal with the external side surface of the border blocks. A suitable lateral thickness for border blocks 14 is determined by the finished size of the completed unit.

During assembly the unfilled apertures are placed so as to be between the exterior and interior edge of the border blocks of rectangular frame structure. Thus, during securement (e.g., adherence of the upper border blocks to the lower border blocks) the bordering section 80 of the grid member surrounding the unfilled apertures are fixedly secured between the upper and lower border blocks so as to create a hammocking, free-floating grid which can move with the resilient changes in the exterior frame structure. Border blocks 14 are preferably formed of a highly resilient material such as polyurethane foam having a minimum density of 2.75 PCF (lbs./ft$^3$) and a 25% IFD value of 41–51 lbs. and a minimum 65% IFD value of 98 lbs. determined in accordance with ASTM D3574. The modular elements 24 are preferably formed of a highly resilient material such as polyurethane foam having a minimum density of 2.5 PCF and a 25% IFD value of 31–41 lbs. and a minimum 65% IFD value of 75 lbs. determined in accordance with ASTM D3574. The foregoing characteristics of the border blocks and modular elements represent the preferred embodiment for those components. The present invention also encompasses other types of resilient material and combination of material including the use of other resilient polyurethane foams, foam combinations or arrangements within defined parameters (a few of the more preferred variations in polyurethane material and positioning of different type material components are explained in greater detail below).

The modular elements and border blocks are formed by cutting, shaping and utilizing various foam cutting devices well known in the art.

The border blocks can be cut in a variety of widths to achieve different padding body widths. This ability to achieve different padding body widths by using different border blocks widths (e.g. 3 to 8 inches or more preferably 3 to 5 inches) is particularly advantageous when the present invention is formed as a mattress. Mattress widths are standardized (e.g. 53, 56 and 60 inches in width) and since the individual modular elements for a mattress are preferably all made of the same size (e.g. about a 4 inch width), it is not always possible to meet a standard size when the modular elements extend to the periphery. For example, while a 56" or 60" mattress width might be possible using the same size 4 inch wide modular elements throughout, a 53 inch mattress width might not be possible using the same size modular element. However, with the border block arrangement of the present invention, the border blocks and the portion of the grid member between the stacked border blocks can easily be cut to achieve different widths. Thus, by varying the width of the border blocks, the present invention can easily be varied in width to conform with the standard mattress widths in the industry.

For smaller width mattress sizes, the portion of the grid member can be cut such that the unfilled aperture lying between the stacked border blocks is open ended and defined on its remaining three sides by the bordering sections of the grid member. The peripherally spaced end tabs defined by the two most peripheral bordering sections of the grid member are adhered to the two stacked border blocks so as to achieve the hammocking effect described previously.

The widths of the border block for one padding body can also be varied to achieve special order requests. For example, the border blocks at the ends can be made wider then the border blocks on the sides of the padding body to achieve a more elongated padding body.

Figure 12:
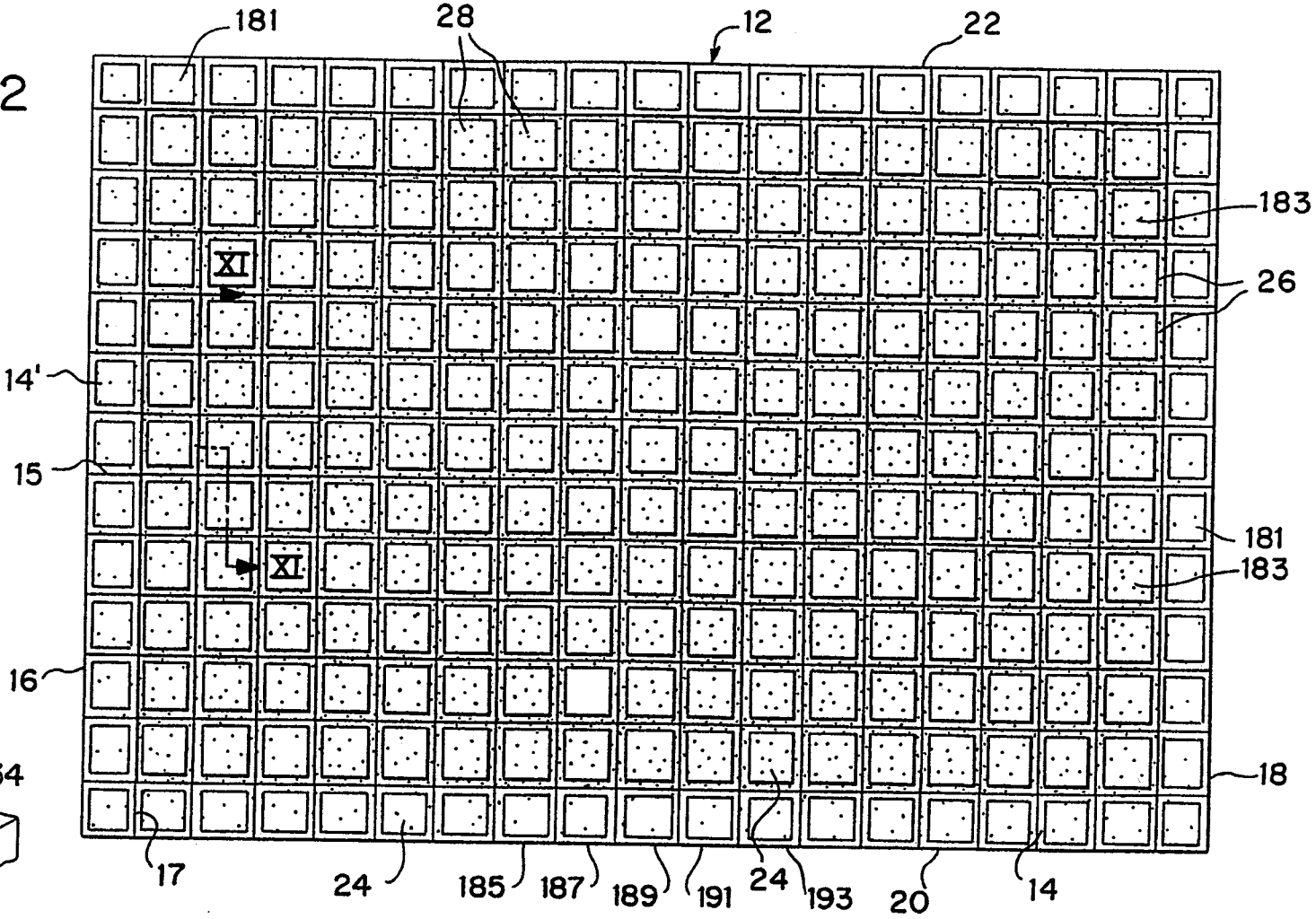
FIG. 12 shows a planar view of an alternate embodiment of the invention.
Figure 8A:
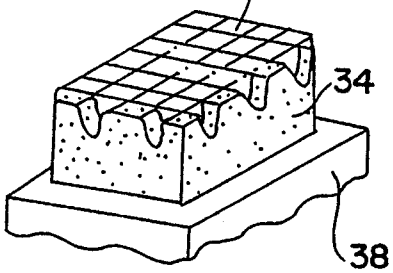
FIG. 8A shows an alternate embodiment.

FIG. 12 illustrates a planar view of an alternate embodiment of the present invention wherein the border blocks are replaced by peripheral modular elements 181 representing the modular elements positioned on the two external most longitudinal rows and the two external most transverse columns of the padding body. In this embodiment, the peripheral modular elements 181 are placed in the aforementioned unfilled apertures 75 described for the previously described embodiment. In the embodiment shown in FIG. 12, both the peripheral modular elements 181 and internal modular elements 183 are formed of the material described for the modular elements in the embodiment shown in FIG. 1. The present invention also contemplates the use of firmer modular elements (e.g., formed of the polyurethane material described above for the border blocks) for the peripheral modular elements and/or for a plurality of intermediate transverse columns of modular elements (e.g., columns 185, 187, 189, 191, 193 in FIG. 12). Preferably, the intermediate transverse columns represent about 20 to 35% of all of the transverse columns of the padding body (e.g. 5 intermediate side-to-side transverse columns with 7 transverse columns positioned at opposite ends of the intermediate columns). Thus, a firmer intermediate support area is provided on the padding body to handle the greater load presented by the hip area of a person while the transverse columns longitudinally spaced from the intermediate transverse rows are less firm (i.e., have lower 25% and 65% IFD values) to provide additional comfort to the lower load legs and chest area.

The present invention also contemplates forming all of the internal and peripheral modular elements of the firmer polyurethane described above. The present invention also encompasses another embodiment similar to that illustrated in FIG. 1 except that an intermediate set of transversely extending columns of modular elements extending between the side border blocks are formed of the same material as the border blocks which, as previously described are firmer than the remaining transverse columns of modular elements. Preferably the firmer intermediate columns constitute about 25 to 35% of all transverse columns. For example, one embodiment of the invention features 5 intermediate transverse columns of modular elements formed of the firmer polyurethane material described for the border blocks. The intermediate transverse columns are positioned between two sets of 6 transverse columns formed of a less firm material and longitudinally spaced outward from the intermediate columns and inward of the end and side border blocks. An additional embodiment of the invention is similar to that described for FIG. 1 except that all modular elements and border blocks are formed of the aforementioned firmer polyurethane material.

Although the present invention has been described with reference to the preferred embodiments, the invention is not limited to the details thereof. Various substitutions and modifications will occur to those of ordinary skill in the art, and all such substitutions and modifications are intended to fall within the spirit and scope of the invention as defined in the appended claims.

We claim:

1. A padding body, comprising:

a flexible grid member having an upper surface and a lower surface and apertures extending between said upper and lower surfaces, and said apertures being defined by bordering sections of said grid member with each bordering section having an upper and a lower surface;

individual modular elements with each modular element being resilient and each having an intermediate section, said individual modular elements each including a peripheral recess formed in said intermediate section and defined by a lower contact surface and an upper contact surface of said intermediate section, and each of said individual modular elements being releasably fixed within a respective one of the apertures formed in said grid member with the bordering sections of said grid member extending into the peripheral recesses formed in said modular elements such that the upper and lower surfaces of said bordering sections are positioned between the upper and lower contact surfaces of said intermediate section; and an external frame structure formed of a resilient material and encompassing said grid member, said frame structure being secured to said grid member to maintain said grid member in a suspended state between an upper and a bottom surface of said external frame structure.

2. A padding body as recited in claim 1 wherein said modular elements further comprise an upper protuberance extending upwardly off from said intermediate section and a bottom protuberance extending downwardly off from said intermediate section and each of said upper and lower protuberances having a horizontal cross-sectional area which is less than a horizontal cross-sectional area of said intermediate section.

3. A padding body as recited in claim 2 wherein said modular elements are unitary foam blocks.

4. A padding body as recited in claim 3 wherein said modular elements have a vertical height equal to that of said external frame structure.

5. A padding body as recited in claim 1 wherein said modular elements are unitary foam blocks and said upper and lower contact surfaces are in contact with respective upper and lower surfaces of said bordering sections when said padding body is in a non-compressed state.

6. A padding body as recited in claim 1 wherein said grid is formed of a pliable plastic material.

7. A padding body as recited in claim 1 wherein said exterior frame structure includes border blocks, and said border blocks being in a stacked arrangement and extending about an external periphery of said grid member, and said grid member including a plurality of unfilled apertures members surrounded by bordering sections and positioned about said external periphery, said unfilled apertures and surrounding bordering sections being received between an upper and a lower one of said stacked border blocks, and said upper and lower border blocks being secured to each other such that said unfilled apertures and surrounding bordering sections are positioned and secured between said upper and lower border blocks.

8. A padding body as recited in claim 7 wherein said border blocks are formed of a polyurethane foam material.

9. A padding body as recited in claim 1 wherein said grid member is comprised of grid segments in an overlapping arrangement and the apertures formed in each of the grid segments are aligned so as to provide through-holes for receiving said modular elements.

10. A padding body as recited in claim 9 further comprising fastening members for fastening the overlapping grid segments together, and said fastening member having central apertures formed therein.

11. A padding body as recited in claim 1 wherein said modular elements are dimensioned and arranged such that, when said modular elements are releasably fixed within the apertures in said grid member, said intermediate sections are within 0 to $\frac{1}{8}$ of an inch (0 to 3 mm) of an adjacent intermediate section and said upper protuberances are spaced $\frac{1}{4}$ to $\frac{1}{2}$ of an inch (6.5–13 mm) away from an adjacent upper protuberance.

12. A padding body as recited in claim 1 wherein said peripheral recess formed in said intermediate section extends inwardly from an external surface of said intermediate section towards a central axis of said modular element for a distance which represents about 25 to 31% of a distance from the exterior surface of said modular element to the central axis of said modular element.

13. A padding body as recited in claim 1 wherein said apertures are arranged in aligned rows and columns with said intermediate sections being dimensioned and arranged such that adjacent intermediate sections are essentially in contact and a plurality of said intermediate sections are adjacent said frame structure and essentially in contact with said frame structure.

14. A padding body as recited in claim 1 wherein said frame structure is are formed of a first type of polyurethane foam and said modular elements are formed of a second type of polyurethane foam which is less firm than the first type of polyurethane foam.

15. A padding body as recited in claim 14 wherein said first type of polyurethane foam has a density of about 2.75 PCF and a 25% IFD value of about 41–51 lbs. and a minimum 65% IFD value of about 98 lbs.

16. A padding body as recited in claim 15 wherein said second type of polyurethane foam has a density of about 2.5 PCF, a 25% IFD value of 31–41 lbs. and a minimum 65% IFD value of 75 lbs.

17. A padding body as recited in claim 1 wherein said frame structure and a first set of transverse columns of modular elements positioned intermediate along a longitudinal length of said padding body are formed of a first type of polyurethane foam, and a second and third set of transverse columns positioned longitudinally outward of said first set of transverse columns of modular elements are formed of a second type of polyurethane foam which is less firm than said first type of polyurethane foam.

18. A padding body as recited in claim 17 wherein said first set of transverse columns of modular elements represent about 20–35% of all transverse columns of modular elements.

19. A padding body as recited in claim 17 wherein said first type of polyurethane foam includes polyurethane foam having a 25% IFD value of about 41–51 lbs. and a minimum 65% IFD value of about 98 lbs. and said second type of polyurethane foam has a 25% IFD value of about 31–41 lbs. and a minimum 65% IFD value of 75 lbs.

20. A padding body as recited in claim 1 wherein said modular elements include an upper protuberance which extends upwardly from said intermediate section and has an upper contacting surface which is convoluted.

21. A padding body as recited in claim 1 wherein said external frame structure and modular elements are formed of a polyurethane foam having a 25% IFD value of 41–51 lbs. and a 65% IFD value of more than 98 lbs.

22. A padding body, comprising;

a flexible grid member having a plurality of internal apertures formed therein, said internal apertures being defined by bordering sections of said grid member, and said grid member having a plurality of external, unfilled apertures arranged along a peripheral region of said grid member;

a frame structure extending about said peripheral region of said grid member, and said bordering sections defining said unfilled apertures being fixedly received by said frame structure so as to retain said grid member suspended between an upper and a lower surface of said frame structure; and individual modular elements having an intermediate section with a peripheral area greater than that of said apertures, said modular elements each having a peripheral recess formed in said intermediate section, and said bordering sections of the internal apertures formed in said grid member extending within said recesses so as to releasably retain said individual modular elements in position within said grid member.

23. A padding body as recited in claim 22 wherein said modular elements are foam blocks having an upper protuberance extending upwardly from said intermediate section and a bottom protuberance extending downwardly from said intermediate section, and said upper and lower protuberances each having a horizontal cross-sectional area which is less than that of said intermediate section.

24. A padding body as recited in claim 22 wherein the intermediate sections of said modular elements are essentially in contact with intermediate sections of adjacent modular elements and adjacent protuberances are horizontally spaced further apart from one another than adjacent intermediate sections.

25. A padding body as recited in claim 22 wherein said frame structure comprises foam border blocks which are stacked two high with an upper border block adhered to a lower border block and said unfilled apertures being positioned and secured between said upper and lower border blocks.

26. A padding body as recited in claim 22 wherein said grid member is formed of pliable plastic grid segments overlapping in a central area of said grid member such that holes in said grid segments are aligned to form said apertures, and said grid segments being secured together in an area of overlap.

27. A padding body as recited in claim 22 wherein said frame structure is entirely formed of a foam material.

28. A method of assembling a padding body, comprising:

forming a lower border block arrangement;

forming an upper border block arrangement;

positioning a peripheral portion of a grid member between said upper and lower border block arrangements;

securing said upper border block arrangement to said lower border block arrangement;

securing the peripheral portion of said grid member between said upper and lower border block arrangements; and inserting a plurality of individual modular elements into apertures formed in said grid member such that boundary regions of said grid member, which define said apertures, are received within peripheral recesses formed in an intermediate section of said modular elements.

29. A method as recited in claim 28 wherein positioning the peripheral portion of the grid member between said upper and lower border block arrangements includes positioning bordering sections of a plurality of peripheral unfilled apertures extending about the periphery of said grid member between said upper and lower border block arrangements and securing said bordering sections surrounding the peripheral apertures therebetween.

30. A padding body, comprising:

a flexible grid member having an upper surface and a lower surface and apertures extending between said upper and lower surfaces, and said apertures being defined by bordering sections of said grid member with each bordering section having an upper and a lower surface;

individual modular elements with each modular element being resilient and each having an intermediate section with a contact surface adapted for contact with one of said bordering sections such that each individual modular element is releasably fixable within a respective one of the apertures formed in said grid member; and an external frame structure encompassing said grid member, said frame structure being secured to said grid member to maintain said grid member in a suspended state between an upper and a bottom surface of said external frame structure.

31. A padding body as recited in claim 29 wherein said external frame structure is comprised of an upper and lower border block formed of a resilient material, and said grid member is secured between said upper and lower border blocks.

* * * * *